US008806860B2

(12) United States Patent
Kawasaki et al.

(10) Patent No.: US 8,806,860 B2
(45) Date of Patent: Aug. 19, 2014

(54) HYBRID CONSTRUCTION MACHINE

(75) Inventors: Haruhiko Kawasaki, Atsugi (JP); Masahiro Egawa, Kawaguchi (JP)

(73) Assignee: Kayaba Industry Co., Ltd., Tokyo (JP)

( * ) Notice: Subject to any disclaimer, the term of this patent is extended or adjusted under 35 U.S.C. 154(b) by 689 days.

(21) Appl. No.: 13/143,756

(22) PCT Filed: Jul. 2, 2010

(86) PCT No.: PCT/JP2010/061649

§ 371 (c)(1),
(2), (4) Date: Jul. 8, 2011

(87) PCT Pub. No.: WO2011/004880

PCT Pub. Date: Jan. 13, 2011

(65) Prior Publication Data

US 2011/0271669 A1 Nov. 10, 2011

(30) Foreign Application Priority Data

Jul. 10, 2009 (JP) ..... 2009-164281

(51) Int. Cl.

| | |
|---|---|
| ***F16D 31/02*** | (2006.01) |
| ***F15B 13/043*** | (2006.01) |
| ***E02F 9/22*** | (2006.01) |
| ***E02F 9/20*** | (2006.01) |
| *F15B 13/04* | (2006.01) |

(52) U.S. Cl.

CPC ..... *E02F 9/2228* (2013.01); *F15B 13/0433* (2013.01); *F15B 13/0435* (2013.01); *F15B 13/0402* (2013.01); *E02F 9/2296* (2013.01); *E02F 9/2075* (2013.01); *E02F 9/2217* (2013.01); *F15B 13/0405* (2013.01); *E02F 9/2292* (2013.01); *E02F 9/2285* (2013.01)

USPC ..... 60/414; 251/63.5; 251/282

(58) Field of Classification Search

USPC ..... 60/414; 251/30.01, 63.5, 282

See application file for complete search history.

(56) References Cited

U.S. PATENT DOCUMENTS

| | | | | |
|---|---|---|---|---|
| 6,151,894 | A * | 11/2000 | Endo et al. | 60/414 |
| 6,378,301 | B2 * | 4/2002 | Endo et al. | 60/414 |
| 6,708,787 | B2 * | 3/2004 | Naruse et al. | 180/53.8 |
| 6,725,581 | B2 | 4/2004 | Naruse et al. | |
| 7,249,457 | B2 * | 7/2007 | Raszga et al. | 60/414 |

(Continued)

FOREIGN PATENT DOCUMENTS

| | | |
|---|---|---|
| DE | 199 32 139 B4 | 6/2009 |
| JP | 57-086602 A | 5/1982 |

(Continued)

*Primary Examiner* — Michael Leslie
(74) *Attorney, Agent, or Firm* — Rabin & Berdo, P.C.

(57) ABSTRACT

A hybrid construction machine includes a control valve provided in a flow passage that connects an actuator to a regenerative hydraulic motor, an opening of which is controlled by a pilot pressure led to a pilot chamber thereof; and a solenoid pilot control valve that leads a pressure on an upstream side of the control valve to the pilot chamber. In the control valve, a pressure receiving area of a main spool for receiving the pilot pressure is equal to an area obtained by subtracting a pressure receiving area of the main spool for receiving a pressure of an outflow port in a direction for moving the main spool against a biasing force of a biasing member from a pressure receiving area of the main spool for receiving a pressure of the outflow port in a direction for moving the main spool against the pilot pressure.

3 Claims, 3 Drawing Sheets

(56) References Cited

U.S. PATENT DOCUMENTS

| | | | | |
|---|---|---|---|---|
| 7,565,801 | B2 * | 7/2009 | Tozawa et al. | 60/414 |
| 8,240,143 | B2 * | 8/2012 | Heren et al. | 60/414 |
| 8,321,095 | B2 * | 11/2012 | Kawasaki et al. | 701/50 |
| 8,726,645 | B2 * | 5/2014 | Shang et al. | 60/414 |

FOREIGN PATENT DOCUMENTS

| | | | |
|---|---|---|---|
| JP | 58-502157 | T | 12/1983 |
| JP | 2002-275945 | A | 9/2002 |
| JP | 2004-011168 | A | 1/2004 |
| JP | 2007-327527 | A | 12/2007 |

* cited by examiner

HYBRID CONSTRUCTION MACHINE

TECHNICAL FIELD

This invention relates to a hybrid construction machine in which a battery is charged using a working oil discharged from an actuator.

BACKGROUND ART

In a hybrid structure for a construction machine such as a power shovel, for example, power is generated by rotating a power generator using a surplus output of an engine, the generated power is stored in a battery, and an actuator is operated by driving an electric motor using the power of the battery. Further, power is generated by driving a hydraulic motor to rotate the power generator using a discharge energy of the actuator, whereupon the generated power is likewise stored in the battery and the actuator is operated by driving the electric motor using the power of the battery (see JP2002-275945A).

SUMMARY OF THE INVENTION

When a fracture or the like occurs in a flow passage between the actuator and the hydraulic motor in the conventional hybrid structure described above, it may become impossible to control the actuator, and as a result, runaway may occur.

This invention has been designed in consideration of the problem described above, and an object thereof is to provide a control device for a hybrid construction machine having improved safety.

This invention is a hybrid construction machine that performs regeneration using a working oil discharged from an actuator. The hybrid construction machine comprises a regenerative hydraulic motor rotated by the working oil discharged from the actuator; a power generator connected to the hydraulic motor; a control valve provided in a flow passage that connects the actuator to the hydraulic motor, an opening of which is controlled by a pilot pressure led to a pilot chamber thereof; and a solenoid pilot control valve that leads a pressure on an upstream side of the control valve to the pilot chamber of the control valve as the pilot pressure, wherein the control valve comprises: a main spool that is incorporated to be free to slide into a valve main body such that one end thereof faces the pilot chamber and switches an inflow port and an outflow port between a blocked state and a communicating state; and a biasing member that is housed in a spring chamber faced by the other end of the main spool and biases the main spool against the pilot pressure of the pilot chamber, and a pressure receiving area of the main spool for receiving the pilot pressure of the pilot chamber is equal to an area obtained by subtracting a pressure receiving area of the main spool for receiving a pressure of the outflow port in a direction for moving the main spool against the biasing force of the biasing member from a pressure receiving area of the main spool for receiving a pressure of the outflow port in a direction for moving the main spool against the pilot pressure of the pilot chamber.

According to this invention, a differential pressure between an upstream side and a downstream side of the control valve is maintained at a fixed value at all times, and therefore a flow of working oil passing through the control valve remains constant. Hence, even when a fracture or the like occurs in a flow passage on the downstream side of the control valve, a situation in which control of an actuator becomes impossible can be prevented, and as a result, an improvement in safety can be achieved.

EMBODIMENTS OF THE INVENTION

A hybrid construction machine according to an embodiment of this invention will be described below with reference to the figures. In the following embodiment, a case in which the hybrid construction machine is a power shovel will be described.

Figure 1:
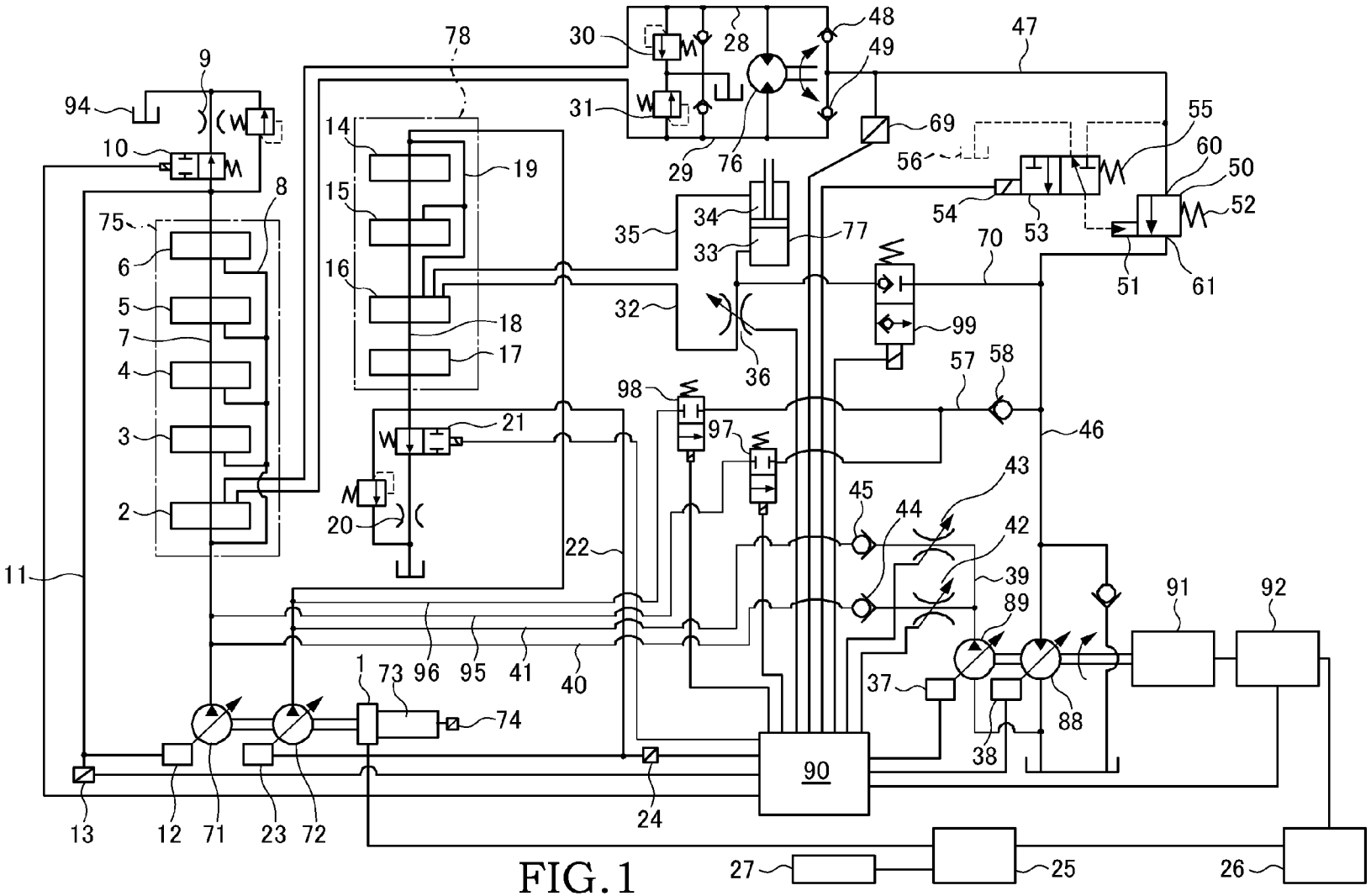
FIG. 1 is a circuit diagram showing a control device for a hybrid construction machine according to an embodiment of this invention.

As shown in FIG. 1, the power shovel is provided with a first main pump 71 and a second main pump 72, which are variable volume type pumps that driven by an engine 73 serving as a prime mover. The first and second main pumps 71, 72 rotate coaxially. The engine 73 is provided with a generator 1 that exhibits a power generation function using a surplus force of the engine 73. The engine 73 is also provided with a rotation speed sensor 74 serving as a rotation speed detector for detecting a rotation speed of the engine 73.

A working oil discharged from the first main pump 71 is supplied to a first circuit system 75. The first circuit system 75 includes, in order from an upstream side, an operation valve 2 that controls a turning motor 76, an operation valve 3 that controls an arm cylinder (not shown), a boom two-speed operation valve 4 that controls a boom cylinder 77, an operation valve 5 that controls a preliminary attachment (not shown), and an operation valve 6 that controls a first travel motor (not shown) for leftward travel. The operation valves 2 to 6 control operations of respective actuators by controlling a flow of discharge oil led to the respective actuators from the first main pump 71.

The respective operation valves 2 to 6 and the first main pump 71 are connected via a neutral flow passage 7 and a parallel flow passage 8 that is parallel to the neutral flow passage 7. A throttle 9 for generating a pilot pressure is provided in the neutral flow passage 7 on a downstream side of the operation valves 2 to 6. The throttle 9 generates a higher pilot pressure on an upstream side thereof as a flow passing through the throttle 9 increases, and generates a lower pilot pressure on the upstream side as the flow passing through the throttle 9 decreases.

When all of the operation valves 2 to 6 are in a neutral position or in the vicinity of the neutral position, the neutral flow passage 7 leads all or a part of the working oil discharged from the first main pump 71 to a tank 94 through the throttle 9. At this time, the flow passing through the throttle 9 increases, and therefore a high pilot pressure is generated.

When the operation valves 2 to 6 are switched to a full stroke condition, on the other hand, the neutral flow passage 7 is closed such that the fluid stops flowing. In this case, the flow passing through the throttle 9 is substantially eliminated, and therefore the pilot pressure is held at zero. Depending on an operation amount of the operation valves 2 to 6, however, a part of the working oil discharged from the first main pump 71 is led to an actuator while the remainder is led to the tank from the neutral flow passage 7, and therefore the throttle 9 generates a pilot pressure that corresponds to the flow of working oil through the neutral flow passage 7. In other words, the throttle 9 generates a pilot pressure that corresponds to the operation amount of the operation valves 2 to 6.

A neutral flow passage switching solenoid valve 10 is provided in the neutral flow passage 7 between the furthest downstream operation valve 6 and the throttle 9. A solenoid of the neutral flow passage switching solenoid valve 10 is connected to a controller 90. When the solenoid is not excited, the neutral flow passage switching solenoid valve 10 is set in an open position serving as a normal position shown in the figure by a spring force action of a spring, and when the solenoid is excited, the neutral flow passage switching solenoid valve 10 is set in an closed position against the spring force of the spring.

A pilot flow passage 11 is connected to the neutral flow passage 7 between the operation valve 6 and the neutral flow passage switching solenoid valve 10. The pressure generated on the upstream side of the throttle 9 is led to the pilot flow passage 11 as the pilot pressure. The pilot flow passage 11 is connected to a regulator 12 serving as a tilt angle controller for controlling a tilt angle of the first main pump 71. The regulator 12 controls a displacement amount per revolution of the first main pump 71 by controlling the tilt angle of the first main pump 71 in inverse proportion to the pilot pressure in the pilot flow passage 11. Hence, when the operation valves 2 to 6 perform a full stroke such that the flow in the neutral flow passage 7 disappears and the pilot pressure in the pilot flow passage 11 reaches zero, the tilt angle of the first main pump 71 reaches a maximum, thereby maximizing the displacement amount per revolution.

The pilot flow passage 11 is provided with a first pressure sensor 13 serving as a pressure detector for detecting the pressure in the pilot flow passage 11. A pressure signal detected by the first pressure sensor 13 is output to the controller 90. The pilot pressure in the pilot flow passage 11 varies in accordance with the operation amount of the operation valves 2 to 6, and therefore the pressure signal detected by the first pressure sensor 13 varies in accordance with a required flow of the first circuit system 75.

A pressure generated upstream of the throttle 9 when the operation valves 2 to 6 are substantially in the neutral position is stored in advance in the controller 90 as a set pressure. When the pressure signal from the first pressure sensor 13 reaches the set pressure, the controller 90 determines that the operation valves 2 to 6 are substantially in the neutral position and the actuators connected to the operation valves 2 to 6 are inoperative, and therefore excites the neutral flow passage switching solenoid valve 10 to switch the valve to the closed position. When the neutral flow passage switching solenoid valve 10 has been switched to the closed position, the regulator 12 receives an action of the pilot pressure in the pilot flow passage 11 and controls the tilt angle of the first main pump 71. As a result, the first main pump 71 discharges a standby flow. When the operation valves 2 to 6 are switched from the neutral position such that the pressure signal from the first pressure sensor 13 falls below the set pressure, the controller 90 halts excitation of the neutral flow passage switching solenoid valve 10 to switch the valve to the open position.

The second main pump 72 is connected to a second circuit system 78. The second circuit system 78 includes, in order from an upstream side, an operation valve 14 that controls a second travel motor (not shown) for rightward travel, an operation valve 15 that controls a bucket cylinder (not shown), an operation valve 16 that controls the boom cylinder 77, and an arm two-speed operation valve 17 that controls the arm cylinder (not shown). A sensor is provided on the operation valve 16 to detect an operation direction and an operation amount thereof, and a detection signal from the sensor is output to the controller 90. The operation valves 14 to 17 control operations of respective actuators by controlling a flow of discharge oil led to the respective actuators from the second main pump 72.

The respective operation valves 14 to 17 and the second main pump 72 are connected via a neutral flow passage 18 and a parallel flow passage 19 that is parallel to the neutral flow passage 18. A throttle 20 for generating a pilot pressure is provided in the neutral flow passage 18 on a downstream side of the operation valves 14 to 17. The throttle 20 functions identically to the throttle 9 on the first main pump 71 side.

A neutral flow passage switching solenoid valve 21 is provided in the neutral flow passage 18 between the furthest downstream operation valve 17 and the throttle 20. The neutral flow passage switching solenoid valve 21 is constituted identically to the neutral flow passage switching solenoid valve 10 on the first main pump 71 side.

A pilot flow passage 22 is connected to the neutral flow passage 18 between the operation valve 17 and the neutral flow passage switching solenoid valve 21. The pressure generated on the upstream side of the throttle 20 is led to the pilot flow passage 22 as the pilot pressure. The pilot flow passage 22 is connected to a regulator 23 serving as a tilt angle controller for controlling a tilt angle of the second main pump 72. The regulator 23, similarly to the regulator 12 of the first main pump 71, controls a displacement amount per revolution of the second main pump 72 by controlling the tilt angle of the second main pump 72 in inverse proportion to the pilot pressure in the pilot flow passage 22.

A second pressure sensor 24 serving as a pressure detector for detecting the pressure in the pilot flow passage 22 is provided in the pilot flow passage 22, similarly to the pilot flow passage 11. Similarly to the first main pump 71 side, the controller 90 switches the neutral flow passage switching solenoid valve 21 on the basis of a pressure signal from the second pressure sensor 24.

Passages 28, 29 that communicate with the turning motor 76 are connected to an actuator port of the turning motor operation valve 2, and brake valves 30, 31 are connected respectively to the passages 28, 29. When the operation valve 2 is held in the neutral position, the actuator port is closed such that the turning motor 76 is maintained in a stopped condition.

When the operation valve 2 is switched in any one direction from a state in which the turning motor 76 is stopped, one of the passages 28 is connected to the first main pump 71 and the other passage 29 communicates with the tank. As a result, a working oil is supplied from the passage 28 to cause the turning motor 76 to rotate, and a return oil from the turning motor 76 is returned to the tank through the passage 29. When the operation valve 2 is switched in an opposite direction to the above direction, the passage 29 is connected to the first main pump 71, the passage 28 communicates with the tank, and the turning motor 76 rotates in reverse.

While the turning motor 76 rotates, the brake valve 30 or 31 exhibits a relief valve function such that when the passages 28, 29 reach or exceed a set pressure, the brake valves 30, 31 open, thereby holding the pressure in the passages 28, 29 at the set pressure. Further, when the operation valve 2 is returned to the neutral position while the turning motor 76 rotates, the actuator port of the operation valve 2 closes. Hence, the turning motor 76 continues to rotate using inertial energy even when the actuator port of the operation valve 2 is closed, and therefore the turning motor 76 exhibits a pump action. At this time, a closed circuit is formed by the passages 28, 29, the turning motor 76, and the brake valves 30, 31 and the inertial energy is converted into thermal energy by the brake valves 30, 31.

When the operation valve 16 is switched in one direction from the neutral position, the working oil discharged from the second main pump 72 is supplied to a piston side chamber 33 of the boom cylinder 77 through a passage 32, and a return oil from a rod side chamber 34 is returned to the tank through a passage 35, whereby the boom cylinder 77 expands. When the operation valve 16 is switched in an opposite direction to the above direction, the working oil discharged from the second main pump 72 is supplied to the rod side chamber 34 of the boom cylinder 77 through the passage 35 and a return oil from the piston side chamber 33 is returned to the tank through the passage 32, whereby the boom cylinder 77 contracts. The boom two-speed operation valve 4 is switched in conjunction with the operation valve 16.

A proportional solenoid valve 36, an opening of which is controlled by the controller 90, is provided in the passage 32 that connects the piston side chamber 33 of the boom cylinder 77 to the operation valve 16. Under normal conditions, the proportional solenoid valve 36 is held in a fully open position.

Next, a variable volume assist pump 89 that assists the outputs of the first and second main pumps 71, 72 will be described. The assist pump 89 is coupled to a regenerative hydraulic motor 88 so as to rotate coaxially therewith. The hydraulic motor 88 is a variable volume motor that is connected to a power generator 91. The assist pump 89 rotates using a driving force generated by the power generator 91 when the power generator 91 is used as an electric motor. At this time, the hydraulic motor 88 coupled to the assist pump 89 also rotates. A battery 26 is connected to the power generator 91 via an inverter 92, and a rotation speed and so on of the power generator 91 functioning as an electric motor is controlled by the controller 90, which is connected to the inverter 92. Further, tilt angles of the assist pump 89 and the hydraulic motor 88 are controlled by regulators 37, 38 serving as tilt angle controllers, while the regulators 37, 38 are controlled by control signals from the controller 90. It should be noted that hereafter, in cases where the power generator 91 functions as an electric motor, the power generator 91 will be referred to as the "electric motor 91".

A discharge passage 39 is connected to the assist pump 89. The discharge passage 39 bifurcates into a first assist flow passage 40 that converges with a discharge side of the first main pump 71 and a second assist flow passage 41 that converges with a discharge side of the second main pump 72. First and second solenoid proportional throttle valves 42, 43, respective openings of which are controlled by control signals from the controller 90, are provided in the first and second assist flow passages 40, 41, respectively. Further, check valves 44, 45 that allow the working oil to flow only from the assist pump 89 to the respective discharge sides of the first and second main pumps 71, 72 are provided respectively in the first and second assist flow passages 40, 41 downstream of the first and second solenoid proportional throttle valves 42, 43.

A connecting flow passage 46 is connected to the regenerative hydraulic motor 88. The connecting flow passage 46 is connected to the passages 28, 29 connected to the turning motor 76 via an introduction flow passage 47 and check valves 48, 49.

A pressure control valve 50 constituted by a pilot operated valve is provided in the introduction flow passage 47. A pilot chamber 51 to which the pilot pressure is led and a spring 52 opposing the pilot chamber 51 are provided in the pressure control valve 50. An opening of the pressure control valve 50 is controlled by an action of the pilot pressure led to the pilot chamber 51.

A solenoid pilot control valve 53 that leads a pressure in the introduction flow passage 47 on an upstream side of the pressure control valve 50 to the pilot chamber 51 as the pilot pressure is provided between the introduction flow passage 47 and the pilot chamber 51. A solenoid 54 and a spring 55 opposing the solenoid 54 are provided in the solenoid pilot control valve 53. The solenoid 54 is connected to the controller 90. The solenoid pilot control valve 53 is ON-OFF controlled by the controller 90 such that when the solenoid 54 is in a non-excited condition, the solenoid pilot control valve 53 is set in a blocking position, which is a normal position shown in the figure, by a biasing force of the spring 55, and when the solenoid 54 is in an excited condition, the solenoid pilot control valve 53 is set in a communicating position such that the spring 55 is compressed. In the blocking position, the pilot chamber 51 of the pressure control valve 50 is cut off from the introduction flow passage 47 but communicates with a tank 56, and as a result, the pilot chamber 51 reaches atmospheric pressure. In the communicating position, on the other hand, the pressure of the introduction flow passage 47 is led to the pilot chamber 51 as the pilot pressure, and as a result, the pressure control valve 50 is set at an opening corresponding to the pilot pressure.

Figure 2:
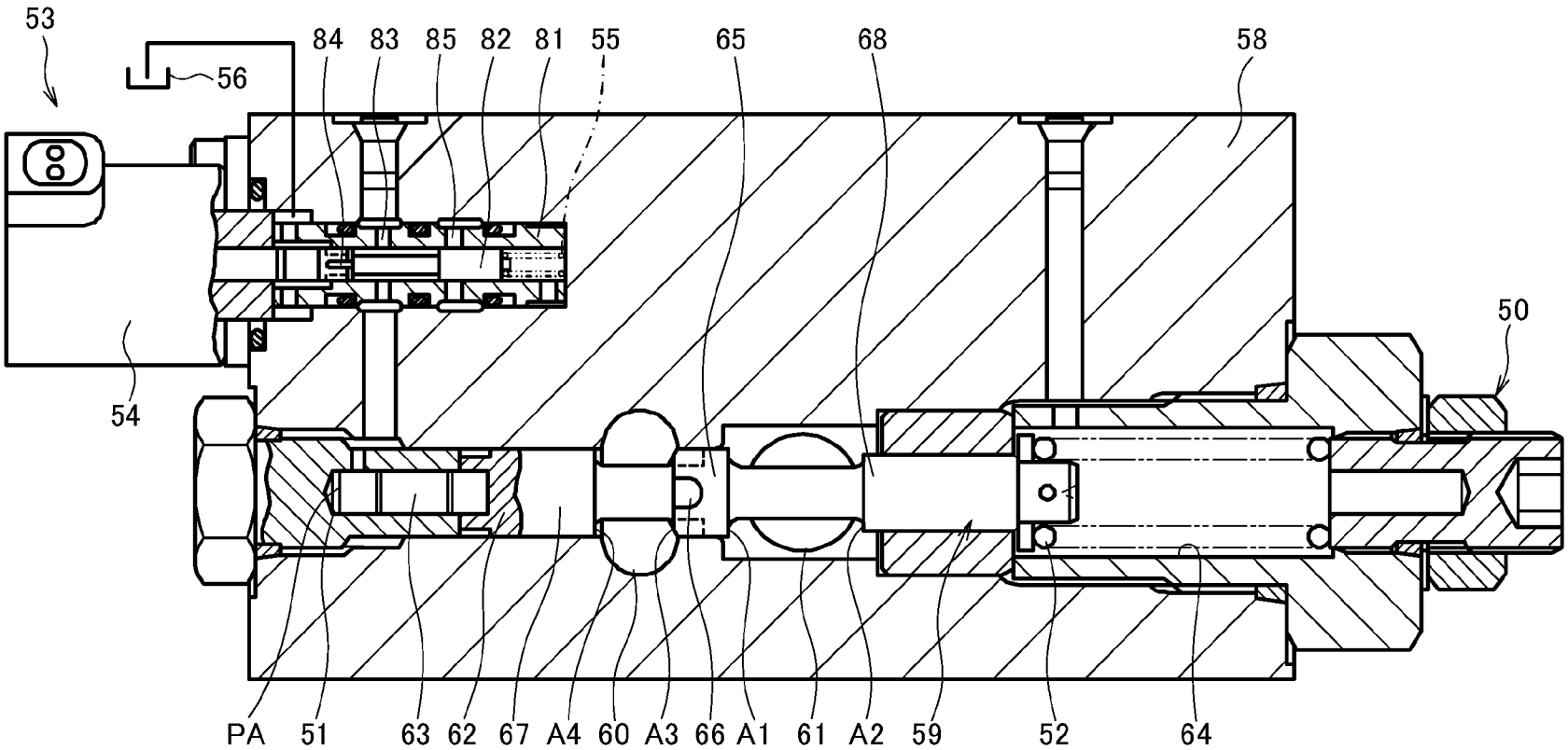
FIG. 2 is a sectional view of a valve main body into which a pressure control valve and a solenoid pilot control valve are incorporated.

As shown in FIG. 2, the pressure control valve 50 and the solenoid pilot control valve 53 are integrally incorporated into a valve main body 58. The structure of the pressure control valve 50 and the solenoid pilot control valve 53 will be described in detail below.

First, the pressure control valve 50 will be described. An inflow port 60 and an outflow port 61 of the pressure control valve 50 are provided in the valve main body 58. Further, a main spool 59 that switches the inflow port 60 and the outflow port 61 between a communicating state and a blocked state is incorporated into the valve main body 58 to be free to slide.

The main spool 59 is divided into a spool main body 62 and a piston portion 63 incorporated into the spool main body 62 to be free to slide. An end portion of the spool main body 62 faces a spring chamber 64, and an end portion of the piston portion 63 faces the pilot chamber 51. Hence, the main spool 59 is disposed such that one end thereof faces the spring chamber 64 and the other end faces the pilot chamber 51. The spring 52, which serves as a biasing member for biasing the main spool 59 against the pilot pressure in the pilot chamber 51, is housed in the spring chamber 64. Accordingly, a biasing force of the spring 52 acts on one end of the main spool 59 and a load generated by the pilot pressure in the pilot chamber 51 acts on the other end.

When the solenoid pilot control valve 53 is set in the communicating position, the pilot chamber 51 communicates with the inflow port 60, and therefore the pilot pressure acting on the pilot chamber 51 becomes equal to a pressure in the inflow port 60.

Under normal conditions, the main spool 59 is maintained in a neutral position shown in FIGS. 1 and 2 by the biasing force of the spring 52 such that communication between the inflow port 60 and the outflow port 61 is blocked. When the load generated by the pilot pressure in the pilot chamber 51 surpasses the biasing force of the spring 52, on the other hand, the main spool 59 moves against the biasing force of the spring 52 such that the inflow port 60 communicates with the outflow port 61 through a notch 66 formed in a first land portion 65, and as a result, the pressure control valve 50 opens. The notch 66 is formed such that an opening area relative to the outflow port 61 varies in accordance with a movement amount of the main spool 59. More specifically, the notch 66 is shaped such that under normal conditions, communication with the outflow port 61 is blocked, but when the main spool 59 moves against the biasing force of the spring 52, the inflow port 60 communicates with the outflow port 61, and the opening area open to the outflow port 61 increases gradually in accordance with the movement amount of the main spool 59.

The piston portion 63 is formed with a diameter that is smaller than a minimum diameter of the spool main body 62. In other words, a pressure receiving area of the piston portion 63 that receives the pilot pressure in the pilot chamber 51 is smaller than a sectional area of a minimum diameter portion of the spool main body 62. By dividing the main spool 59 into the spool main body 62 and the piston portion 63 in this manner, the pressure receiving area of the main spool 59 that receives the pilot pressure in the pilot chamber 51 can be reduced, and therefore the main spool 59 can be balanced using a smaller spring force. As a result, the spring 52 can be reduced in size, enabling a corresponding reduction in the size of the pressure control valve 50.

The main spool 59 includes the first land portion 65 having one end surface that faces the inflow port 60, the other end surface that faces the outflow port 61, and formed with the notch 66, a second land portion 67 having one end surface that faces the inflow port 60, and a third land portion 68 having one end surface that faces the outflow portion 61. In other words, the pressure of the inflow port 60 acts on the first land portion 65 and the second land portion 67, and the pressure of the outflow port 61 acts on the first land portion 65 and the third land portion 68.

The pressure receiving area of the main spool 59 that receives the pilot pressure in the pilot chamber 51 is set as PA. Further, a pressure receiving area of the first land portion 65 that receives the pressure of the outflow port 61, or in other words a pressure receiving area of the main spool 59 that receives a pressure of the outflow port 61 in a direction for moving the main spool 59 against the pilot pressure in the pilot chamber 51 is set as A1. Furthermore, a pressure receiving area of the third land portion 68 that receives the pressure of the outflow port 61, or in other words a pressure receiving area of the main spool 59 that receives a pressure of the outflow port 61 in a direction for moving the main spool 59 against the biasing force of the spring 52 is set as A2. The respective pressure receiving areas PA, A1, A2 are set to have a relationship of PA=A1−A2. In other words, PA is set to be equal to a difference between A1 and A2.

Meanwhile, a pressure receiving area A3 of the first land portion 65 that receives the pressure of the inflow port 60 and a pressure receiving area A4 of the second land portion 67 that receives the pressure of the inflow port 60 are set to be equal. Therefore, the pressure of the inflow port 60 does not affect the movement of the main spool 59.

When the pressure of the inflow port 60, or in other words the pressure in the pilot chamber 51, is set at P1, the pressure in the outflow port is set at P2, and the spring force of the spring 52 is set at F, a balance of the forces acting on the main spool 59 is expressed by a following equation.

$$PA \times P1 = (A1 - A2) \times P2 + F$$

Here, as noted above, PA=A1−A2, and therefore the above equation is as follows.

$$PA \times P1 = PA \times P2 + F$$

When this equation is arranged by dividing both sides by PA, the following equation is obtained.

$$P1 - P2 = F/PA$$

As is evident from this equation, a differential pressure (P1−P2) between the inflow port 60 and the outflow port 61 takes a fixed value.

Since the differential pressure between the inflow port 60 and the outflow port 61 is maintained at a fixed value, the flow of the working oil that passes through the pressure control valve 50 is also maintained at a fixed value. Hence, even when a defect such as a fracture occurs in the flow passage system on the downstream side of the pressure control valve 50, a dangerous situation such as runaway of turning motor 76 can be prevented.

In the solenoid pilot control valve 53, a pilot spool 82 is incorporated into a sleeve 81 to be free to slide. When the solenoid 54 is in the non-excited condition, the pilot spool 82 is held in a blocking position, which is a normal position shown in FIGS. 1 and 2, by the biasing force of the spring 55. When the pilot spool 82 is in the normal position, a pilot port 83 that communicates with the pilot chamber 51 communicates with the tank 56 via a notch 84.

When the solenoid 54 is excited such that the pilot spool 82 moves against the biasing force of the spring 55, communication between the pilot port 83 and the tank 56 is blocked, and an in-port 85 that communicates with the introduction flow passage 47 communicates with the pilot port 83 such that the pressure in the introduction flow passage 47 is led to the pilot chamber 51 as the pilot pressure. As a result, the pressure control valve 50 is set at an opening corresponding to the pilot pressure. At this time, the pilot chamber 51 communicates with the inflow port 60 via the pilot port 83, the in-port 85, and the introduction flow passage 47, and therefore the pilot pressure in the pilot chamber 51 becomes equal to the pressure of the inflow port 60.

Figure 3:
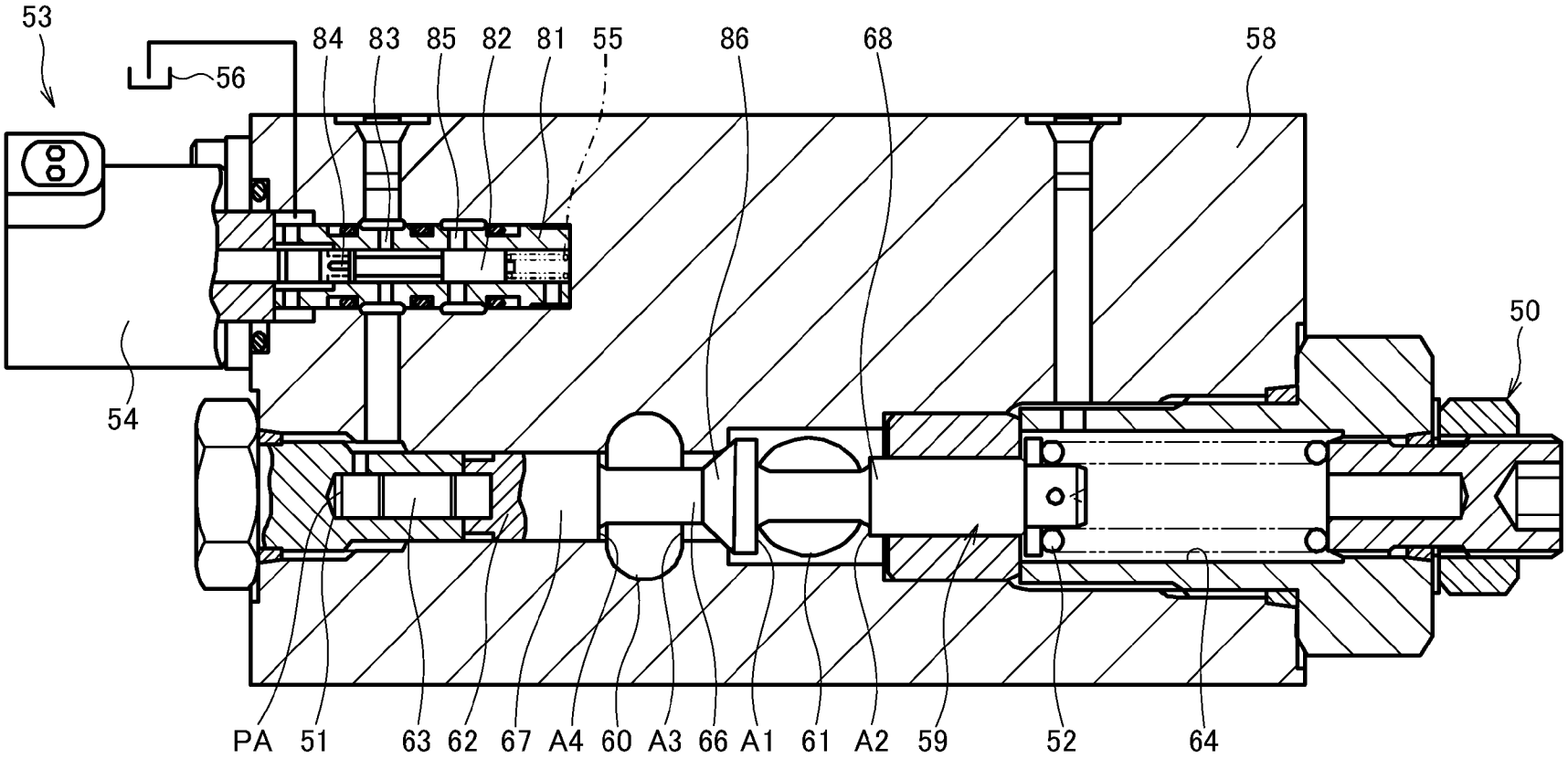
FIG. 3 is a sectional view of a valve main body into which a pressure control valve and a solenoid pilot control valve are incorporated.

FIG. 3 shows a modified example of this embodiment. In the example shown in FIG. 3, the first land portion 65 of the embodiment is modified to a poppet portion 86. However, the pressure receiving area of the main spool 59 and all other constitutions are identical to those of the embodiment.

As shown in FIG. 1, a pressure sensor 69 for detecting a pressure generating during a turning operation in the turning motor 76 or a pressure generating during a braking operation performed on the turning motor 76 is provided in the introduction flow passage 47 between the pressure control valve 50 and the check valves 48, 49. A pressure signal from the pressure sensor 69 is output to the controller 90.

An introduction passage 70 that communicates with the connecting flow passage 46 is connected between the boom cylinder 77 and the proportional solenoid valve 36. A solenoid open/close valve 99, an opening of which is controlled by the controller 90, is provided in the introduction passage 70.

Standby flow passages 95, 96 are connected respectively to the first and second main pumps 71, 72, and solenoid valves 97, 98 are provided respectively in the standby flow passages 95, 96. The standby flow passages 95, 96 are connected to the first and second main pumps 71, 72 on the upstream side of the first and second circuit systems 75, 78. A spring is provided on one end of the solenoid valves 97, 98, and a solenoid connected to the controller 90 is provided on the other end. Under normal conditions in which the solenoids are not excited, the solenoid valves 97, 98 are maintained in a closed position shown in the figure, but when the solenoids are excited, the solenoid valves 97, 98 are switched to an open position.

The standby flow passages 95, 96 are connected to the first and second main pumps 71, 72 on the upstream side of the first and second circuit systems 75, 78 in order to reduce pressure loss in the working oil led to the standby flow passages 95, 96. The standby flow passages 95, 96 converge with a converging flow passage 57, and the converging flow passage 57 is connected to the connecting flow passage 46. A check valve 79 that allows the working oil to flow only from the first and second main pumps 71, 72 to the hydraulic motor 88 is provided in the converging flow passage 57.

Next, an action of the hydraulic circuit described above will be described.

When the operation valves 2 to 6, 14 to 17 of the first and second circuit systems 75, 78 are held in the neutral position, an entire discharge flow from the first and second main pumps 71, 72 is led to the tank 94 from the neutral flow passages 7, 18 via the throttles 9, 20. When the entire pump discharge flow is led to the tank 94 via the throttles 9, 20 in this manner, the pressure on the upstream side of the throttles 9, 20 rises, and this pressure is led to the regulators 12, 23 through the pilot flow passages 11, 22. As a result, the regulators 12, 23 reduce the tilt angle of the first and second main pumps 71, 72 using the action of the pilot pressure in the pilot flow passages 11, 22 such that the discharge flow from the first and second main pumps 71, 72 is set at a standby flow.

When the pilot pressure in the pilot flow passages 11, 22 reaches the set pressure, the controller 90 switches the neutral flow passage switching solenoid valves 10, 21 to the closed position. Even when the neutral flow passage switching solenoid valves 10, 21 are switched to the closed position, the pressure of the pilot flow passages 11, 22 continues to act on the regulators 12, 23 such that the first and second main pumps 71, 72 discharge the standby flow. At this time, the controller 90 excites the solenoids of the solenoid valves 97, 98 to switch the solenoid valves 97, 98 from the closed position to the open position. As a result, the standby flow discharged from the first and second main pumps 71, 72 is supplied to the hydraulic motor 88 via the standby flow passages 95, 96, the solenoid valves 97, 98, the converging flow passage 57, and the connecting flow passage 46.

When the standby flow discharged from the first and second main pumps 71, 72 is supplied to the hydraulic motor 88, the controller 90 controls the regulator 38 to set the tilt angle of the hydraulic motor 88 at a pre-stored set tilt angle and controls the regulator 37 to set the tilt angle of the assist pump 89 to zero. Further, the controller 90 maintains the power generator 91 in a regenerative condition via the inverter 92. As a result, the power generator 91 is rotated by the driving force of the hydraulic motor 88 so as to exhibit a power generation function. Hence, a standby regeneration operation for causing the power generator 91 to exhibit a power generation function is performed using the standby flow from the first and second main pumps 71, 72. The power generated by the power generator 91 is stored in the battery 26, and the power stored in the battery 26 is used by the power generator 91 as a power source when functioning as an electric motor.

According to the above description, the standby regeneration operation is performed when all of the operation valves 2 to 6, 14 to 17 of the first and second circuit systems 75, 78 are held in the neutral position. However, the standby regeneration operation is also performed by rotating the hydraulic motor 88 when one of the first and second circuit systems 75, 78, or in other words either the operation valves 2 to 6 or the operation valves 14, to 17, is in the neutral position. In other words, the controller 90 sets the solenoid valve 97 in the open position on the basis of the pressure signal from the first pressure sensor 13 and sets the solenoid valve 98 in the open position on the basis of the pressure signal from the second pressure sensor 24. When the oil discharged from one of the first and second main pumps 71, 72 is supplied to the hydraulic motor 88 in this manner, the power generator 91 is rotated by the driving force of the hydraulic motor 88, and as a result, power is generated.

Next, a case in which an assist force of the assist pump 89 is used will be described. An assist flow of the assist pump 89 is stored in advance in the controller 90, and on the basis of the stored assist flow, the controller 90 performs control to determine how to control the tilt angle of the assist pump 89, the tilt angle of the hydraulic motor 88, the rotation speed of the electric motor 91, and so on with maximum efficiency.

If the neutral flow passage switching solenoid valves 10, 21 are held in the closed position when the operation valves 2 to 6 of the first circuit system 75 or the operation valves 14 to 17 of the second circuit system 78 are switched, the controller 90 switches the neutral flow passage switching solenoid valves 10, 21 to the open position. As a result, the pilot pressure in the pilot flow passages 11, 22 decreases such that a signal indicating the reduced pilot pressure is input into the controller 90 via the first and second pressure sensors 13, 24. On the basis of the pilot pressure signal, the controller 90 controls the regulators 12, 23 such that the discharge flow from the first and second main pumps 71, 72 increases. At the same time, the controller 90 switches the solenoid valves 97, 98 to the closed position so that the entire discharge flow from the first and second main pumps 71, 72 is supplied to the actuators of the first and second circuit systems 75, 78.

When the discharge flow from the first and second main pumps 71, 72 increases, the controller 90 maintains the electric motor 91 in a constantly rotating condition. The power stored in the battery 26 is used as a drive source of the electric motor 91, and since a part of this power is stored using the standby flow of the first and second main pumps 71, 72, extremely favorable energy efficiency is achieved.

When the assist pump 89 is rotated by the driving force of the electric motor 91, the assist flow is discharged from the assist pump 89. The controller 90 controls the openings of the first and second solenoid proportional throttle valves 42, 43 on the basis of the control signals from the first and second pressure sensors 13, 24 such that a discharge amount from the assist pump 89 is supplied proportionally to the first and second circuit systems 75, 78.

When the turning motor operation valve 2 is switched in one direction in order to drive the turning motor 76 connected to the first circuit system 75, the first passage 28 communicates with the first main pump 71, the other passage 29 communicates with the tank, and as a result, the turning motor 76 rotates. A turning pressure generated at this time is maintained at a set pressure of the brake valve 30. When the operation valve 2 is switched in the opposite direction, the other passage 29 communicates with the first main pump 71, the first passage 28 communicates with the tank, and as a result, the turning motor 76 rotates in reverse. The turning pressure generated at this time is maintained at a set pressure of the brake valve 31. Further, when the operation valve 2 is switched to the neutral position as the turning motor 76 turns, a closed circuit is formed between the passages 28, 29 and the brake valve 30 or 31 maintains a brake pressure of the closed circuit such that inertial energy is converted into thermal energy.

The pressure sensor 69 detects the turning pressure or the brake pressure of the turning motor 76 and outputs a corresponding pressure signal to the controller 90. When a pressure within a range that does not affect a turning operation or a braking operation performed on the turning motor 76 and lower than the set pressure of the brake valves 30, 31 is detected, the controller 90 switches the solenoid pilot control valve 53 from the blocking position to the communicating position. When the solenoid pilot control valve 53 is switched to the communicating position, the pressure in the introduction flow passage 47 is led to the pilot chamber 51 of the pressure control valve 50 as the pilot pressure, and the pressure control valve 50 maintains an opening corresponding to the pilot pressure. Accordingly, the working oil discharged from the turning motor 76 is supplied to the hydraulic motor 86 through the connecting flow passage 46. At this time, the controller 90 controls the tilt angle of the hydraulic motor 88 on the basis of the pressure signal from the pressure sensor 69. This control will be described below.

If the pressure in the passages 28, 29 is not held at the pressure required for the turning operation or the braking operation performed on the turning motor 76, the turning motor 76 cannot be caused to turn or a brake cannot be applied thereto. Therefore, to maintain the pressure in the passages 28, 29 at the turning pressure or the brake pressure, the controller 90 controls a load of the turning motor 76 while controlling the tilt angle of the hydraulic motor 88. In other words, the controller 90 controls the tilt angle of the hydraulic motor 88 such that the pressure detected by the pressure sensor 69 becomes substantially equal to the turning pressure or the brake pressure of the turning motor 76.

When the working oil is supplied to the hydraulic motor 88 through the introduction flow passage 47 and the connecting flow passage 46 such that a rotary force is obtained from the hydraulic motor 88, the rotary force acts on the electric motor 91 rotating coaxially with the hydraulic motor 88. The rotary force of the hydraulic motor 88 acts on the electric motor 91 as an assist force, and therefore the power consumed by the electric motor 91 can be reduced by an amount corresponding to the rotary force of the hydraulic motor 88. Further, a rotary force of the assist pump 89 can be assisted by the rotary force of the hydraulic motor 88, and in this case, the hydraulic motor 88 and the assist pump 89 cooperate to exhibit a pressure conversion function.

The pressure of the working oil that flows into the connecting flow passage 46 is often lower than a pump discharge pressure of the first main pump 71. To maintain a high discharge pressure in the assist pump 89 using this low pressure, the hydraulic motor 88 and assist pump 89 are caused to exhibit a boosting function. More specifically, the output of the hydraulic motor 88 is determined by a product of a displacement amount Q1 per revolution and a pressure P1 at that time. Further, the output of the assist pump 89 is determined by a product of a displacement amount Q2 per revolution and a discharge pressure P2 at that time. Since the hydraulic motor 88 and the assist pump 89 rotate coaxially, $Q1 \times P1 = Q2 \times P2$ is established. Hence, by setting the displacement amount Q1 of the hydraulic motor 88 at three times the displacement amount Q2 of the assist pump 89, or in other words by establishing $Q1 = 3Q2$, for example, the above equation becomes $3Q2 \times P1 = Q2 \times P2$. By dividing both sides of the equation by Q2, $3P1 = P2$ is established. Therefore, by varying the tilt angle of the assist pump 89 in order to control the displacement amount Q2, a predetermined discharge pressure can be maintained in the assist pump 89 using the output of the hydraulic motor 88. In other words, an oil pressure from the turning motor 76 can be boosted and discharged from the assist pump 89.

However, the tilt angle of the hydraulic motor 88 is controlled such that the pressure in the passages 28, 29 is held at the turning pressure or the brake pressure, as described above, and therefore, when the oil pressure from the turning motor 76 is used, the tilt angle of the hydraulic motor 88 is determined naturally. Hence, in order to generate a pressure conversion function when the tilt angle of the hydraulic motor 88 is determined, the tilt angle of the assist pump 89 is controlled. It should be noted that when the pressure in the connecting flow passage 46 system falls below the turning pressure or the brake pressure for some reason, the controller 90 closes the pressure control valve 50 on the basis of the pressure signal from the pressure sensor 69 by halting excitation of the solenoid 54 of the solenoid pilot control valve 53 such that communication between the inflow port 60 and the outflow port 61 of the pressure control valve 50 is blocked, thereby ensuring that the turning motor 76 is not affected. Further, when a pressure oil leakage occurs in the connecting flow passage 46, the pressure control valve 50 functions to ensure that the pressure in the passages 28, 29 does not fall excessively, thereby preventing the turning motor 76 from running away.

Next, control of the boom cylinder 77 will be described. When the operation valve 16 is switched in order to operate the boom cylinder 77, the operation direction and operation amount of the operation valve 16 are detected by the sensor (not shown) provided on the operation valve 16 and a corresponding operation signal is output to the controller 90.

In response to the operation signal from the sensor, the controller 90 determines whether the operator wishes to raise or lower the boom cylinder 77. After determining that the boom cylinder 77 is to be raised, the controller 90 maintains the proportional solenoid valve 36 in the fully open position, i.e. in its normal condition. At this time, the controller 90 controls the rotation speed of the electric motor 91 and the tilt angle of the assist pump 89 while maintaining the solenoid open/close valve 99 in the closed position.

After determining that the boom cylinder 77 is to be lowered, on the other hand, the controller 90 calculates a lowering speed of the boom cylinder 77 requested by the operator in accordance with the operation amount of the operation valve 16. Further, the controller 90 closes the proportional solenoid valve 36 and switches the solenoid open/close valve 99 to the open position. As a result, the entire amount of the working oil discharged from the boom cylinder 77 is supplied to the hydraulic motor 88. When the flow consumed by the hydraulic motor 88 is smaller than a flow required to maintain the lowering speed requested by the operator, however, the boom cylinder 77 cannot maintain the lowering speed requested by the operator. In this case, the controller 90 controls the opening of the proportional solenoid valve 36 on the basis of the operation amount of the operation valve 16, the tilt angle of the hydraulic motor 88, the rotation speed of the electric motor 91, and so on such that a flow equal to or greater than the flow consumed by the hydraulic motor 88 is returned to the tank, and as a result, the lowering speed of the boom cylinder 77 is maintained at the lowering speed requested by the operator.

When a pressure oil is supplied to the hydraulic motor 88, the hydraulic motor 88 rotates, and the resulting rotary force acts on the coaxially rotating electric motor 91. The rotary force of the hydraulic motor 88 acts on the electric motor 91 as an assist force, and therefore the power consumed by the electric motor 91 can be reduced by an amount corresponding to the rotary force of the hydraulic motor 88. Further, the assist pump 89 can be rotated by the rotary force of the hydraulic motor 88 alone, i.e. without supplying power to the electric motor 91, and in this case, the hydraulic motor 88 and the assist pump 89 exhibit a pressure conversion function.

Next, a case in which the turning operation of the turning motor 76 and the lowering operation of the boom cylinder 77 are performed at the same time will be described. When the boom cylinder 77 is lowered while the turning motor 76 turns, the pressure oil from the turning motor 76 and the return oil from the boom cylinder 77 are supplied to the hydraulic motor 88 after converging in the connecting flow passage 46. At this time, the pressure in the introduction flow passage 47 increases as the pressure in the connecting flow passage 46 increases. Due to the presence of the check valves 48, 49, the turning motor 76 is not affected even when the pressure in the introduction flow passage 47 increases beyond the turning pressure or the brake pressure of the turning motor 76. Furthermore, when the pressure in the introduction flow passage 47 falls below the turning pressure or the brake pressure, the controller 90 halts excitation of the solenoid 54 of the solenoid pilot control valve 53 on the basis of the pressure signal from the pressure sensor 69 such that communication between the inflow port 60 and the outflow port 61 of the pressure control valve 50 is blocked.

Hence, when the turning operation of the turning motor 76 and the lowering operation of the boom cylinder 77 are performed at the same time, the tilt angle of the hydraulic motor 88 may be determined using the required lowering speed of the boom cylinder 77 as a reference, regardless of the turning pressure or brake pressure of the turning motor 76.

When power generation is performed by the power generator 91 using the hydraulic motor 88 as a drive source, the assist pump 89 is set at a tilt angle of zero so as to enter a substantially no-load condition. As long as the hydraulic motor 88 maintains an output required to rotate the power generator 91, the power generator 91 can be caused to function using the output of the hydraulic motor 88.

The generator 1 provided in the engine 73 is connected to a battery charger 25, and a power generated by the generator 1 is charged to the battery 26 via the battery charger 25. The battery charger 25 is also capable of charging power to the battery 26 when connected to a normal household power supply 27. Hence, the power of the electric motor 91 can be obtained from various sources.

In this system, the check valves 44, 45 are provided together with the pressure control valve 50, the solenoid open/close valve 99, and the solenoid valves 97, 98, and therefore, even when a fault occurs in the system of the hydraulic motor 88 and the assist pump 89, for example, the system of the first and second main pumps 71, 72 can be hydraulically disconnected from the system of the hydraulic motor 88 and the assist pump 89. In particular, under normal conditions, the solenoid open/close valve 99 and the solenoid valves 97, 98 are maintained in the closed position by the spring force of the springs and the proportional solenoid valve 36 is maintained in the fully open position, and therefore the system of the first and second main pumps 71, 72 can be hydraulically disconnected from the system of the hydraulic motor 88 and the assist pump 89 when a fault occurs in an electric system.

The following effects are obtained from the embodiment described above.

When the pressure control valve 50 is open, the differential pressure between the inflow port 60 and the outflow port 61 is constantly maintained at a fixed value, and therefore the flow of working oil passing through the pressure control valve 50 remains constant. Hence, even when a fracture or the like occurs in the flow passage on the downstream side of the pressure control valve 50, a situation in which control of the actuator becomes impossible can be prevented, and as a result, an improvement in safety can be achieved.

Further, the pressure receiving area of the piston portion 63 of the main spool 59 that receives the pilot pressure in the pilot chamber 51 is smaller than the minimum diameter portion of the spool main body 62, and therefore the spring force of the spring 52 housed in the spring chamber 64 that opposes the pilot chamber 51 can be reduced. As a result, the pressure control valve 50 can be reduced in size.

Furthermore, the pressure control valve 50 and the solenoid pilot control valve 53 are incorporated integrally into the valve main body 58, enabling a reduction in the size of the device.

This invention is not limited to the embodiment described above and may be subjected to various amendments and modifications within the scope of the technical spirit thereof, such amendments and modifications naturally being included within the technical scope of this invention. With respect to the above description, the contents of application No. 2009-164281, with a filing date of Jul. 10, 2009 in Japan, are incorporated herein by reference.

Industrial Applicability

This invention may be used in a construction machine such as a power shovel.

The invention claimed is:

1. A hybrid construction machine that performs regeneration using a working oil discharged from an actuator, comprising:

a regenerative hydraulic motor rotated by the working oil discharged from the actuator;

a power generator connected to the hydraulic motor;

a control valve provided in a flow passage that connects the actuator to the hydraulic motor, an opening of which is controlled by a pilot pressure led to a pilot chamber thereof; and a solenoid pilot control valve that leads a pressure on an upstream side of the control valve to the pilot chamber of the control valve as the pilot pressure, wherein the control valve comprises:

a main spool that is incorporated to be free to slide into a valve main body such that one end thereof faces the pilot chamber and switches an inflow port and an outflow port between a blocked state and a communicating state; and a biasing member that is housed in a spring chamber faced by the other end of the main spool and biases the main spool against the pilot pressure of the pilot chamber, and a pressure receiving area of the main spool for receiving the pilot pressure of the pilot chamber is equal to an area obtained by subtracting a pressure receiving area of the main spool for receiving a pressure of the outflow port in a direction for moving the main spool against the biasing force of the biasing member from a pressure receiving area of the main spool for receiving a pressure of the outflow port in a direction for moving the main spool against the pilot pressure of the pilot chamber.

2. The hybrid construction machine as defined in claim 1, wherein the main spool is divided into a spool main body that faces the spring chamber and a piston portion that is incorporated to be free to slide into the spool main body so as to face the pilot chamber, and a pressure receiving area of the piston portion for receiving the pilot pressure of the pilot chamber is smaller than a minimum diameter portion of the spool main body.

3. The hybrid construction machine as defined in claim 1, wherein the solenoid pilot control valve is incorporated into the valve main body.

* * * * *